US006467441B2

(12) United States Patent
Cristiani et al.

(10) Patent No.: US 6,467,441 B2
(45) Date of Patent: Oct. 22, 2002

(54) ELECTROMAGNETIC ACTUATOR FOR THE ACTUATION OF THE VALVES OF AN INTERNAL COMBUSTION ENGINE

(75) Inventors: Marcello Cristiani, Imola; Massimo Marchioni, Bologna; Nicola Morelli, Rende, all of (IT)

(73) Assignee: Magnetti Marelli, S.p.A., Milan (IT)

( * ) Notice: Subject to any disclaimer, the term of this patent is extended or adjusted under 35 U.S.C. 154(b) by 0 days.

(21) Appl. No.: 09/887,948

(22) Filed: Jun. 22, 2001

(65) Prior Publication Data

US 2001/0054401 A1 Dec. 27, 2001

(30) Foreign Application Priority Data

Jun. 23, 2000 (IT) ..... BO2000A000366

(51) Int. Cl.[7] ..... F01L 9/04
(52) U.S. Cl. ..... 123/90.11
(58) Field of Search ..... 123/90.11; 251/129.01, 251/30.01; 310/12, 15; F01L 9/04

(56) References Cited

U.S. PATENT DOCUMENTS

| | | | | |
|---|---|---|---|---|
| 4,395,649 A | * | 7/1983 | Thome et al. | 310/15 |
| 4,634,303 A | | 1/1987 | West et al. | 400/124 |
| 6,257,182 B1 | | 7/2001 | Hara et al. | 123/90.11 |
| 6,262,498 B1 | * | 7/2001 | Leiber | 310/12 |

FOREIGN PATENT DOCUMENTS

| | | |
|---|---|---|
| DE | 197 12 056 | 10/1998 |
| DE | 198 07 181 | 8/1999 |
| DE | 198 52 605 | 5/2000 |
| DE | 199 52 052 | 5/2000 |
| JP | 59-158 266 | 9/1984 |

OTHER PUBLICATIONS

European Search Report dated Oct. 10, 2001 for European Patent Application No. 01114908.5.

* cited by examiner

*Primary Examiner*—Thomas Denion
*Assistant Examiner*—Sean O'Brien
(74) *Attorney, Agent, or Firm*—Baker & Daniels

(57) ABSTRACT

An electromagnetic actuator for the actuation of the intake or exhaust valves of an internal combustion engine in which an oscillating arm has a first end hinged on a support frame secured to the engine head and a second end in abutment on the upper end of the stem of the intake or exhaust valve; two electromagnets being provided in order to move, on command, the oscillating arm in order axially to displace the valve between a closed position and a position of maximum opening, the oscillating arm comprising a central plate positioned in the space between the polar heads of the two electromagnets, a cylindrical tubular member rigid with a lateral edge of the central plate and a projection extending in a projecting manner from the central plate on the side opposite the cylindrical tubular member, the central plate being formed by a pack of sheets of ferromagnetic material stacked on one another and seam welded on the outer lateral surface of the cylindrical tubular member and by a stiffening rib welded to the pack of sheets on the side opposite the cylindrical tubular member.

9 Claims, 2 Drawing Sheets

ELECTROMAGNETIC ACTUATOR FOR THE ACTUATION OF THE VALVES OF AN INTERNAL COMBUSTION ENGINE

The present invention relates to an electromagnetic actuator for the actuation of the valves of an internal combustion engine.

BACKGROUND OF THE INVENTION

As is known, internal combustion engines are currently being tested in which the intake and exhaust valves that selectively bring the combustion chamber of the engine into communication with the intake manifold and the exhaust manifold respectively of the engine are actuated by electromagnetic actuators driven by an electronic control unit. This solution makes it possible to vary, in a very precise manner, the lift, opening time, and opening and closing moments of the valves as a function of the angular speed of the crankshaft and of other operating parameters of the engine, substantially increasing the performance of the engine.

The electromagnetic actuator that currently provides the best performance is disposed alongside the stem of the valve of the internal combustion engine to be axially moved and comprises a support frame secured to the head of the internal combustion engine, an oscillating arm of ferromagnetic material having a first end hinged on the support frame in order to be able to oscillate about an axis of rotation perpendicular to the longitudinal axis of the valve, and a second end shaped as a curved finger disposed in abutment on the upper end of the stem of the valve, and a pair of electromagnets disposed on opposite sides of the central portion of the oscillating arm in order to be able to attract, on command and alternatively, the oscillating arm by causing it to rotate about its axis of rotation.

The electromagnetic actuator lastly comprises two elastic members, the first of which is adapted to maintain the valve of the engine in a closed position and the second of which is adapted to maintain the oscillating arm in a position such as to maintain this valve in the position of maximum opening. The two elastic members act in opposition against one another and are dimensioned such as to position, when neither of the electromagnets is being supplied, i.e. they are in a condition of equilibrium, the oscillating arm in a rest position in which it is substantially equidistant from the polar heads of the two electromagnets so as to maintain the valve of the engine in an intermediate position between the closed position and the position of maximum opening.

The main drawback of the electromagnetic actuator described above is that its electricity consumption is still too high to enable it to be mounted on the internal combustion engines that are normally installed in automobile vehicles. In order to provide for such a large energy requirement it would in practice be necessary to provide the internal combustion engines currently in use with high-power electrical generators of an unacceptably large size.

SUMMARY OF THE INVENTION

The object of the present invention is to provide an electromagnetic actuator for the actuation of the valves of an internal combustion engine that has a lower electricity consumption than current actuators.

The present invention therefore relates to an electromagnetic actuator for the actuation of the valves of an internal combustion engine that comprises a head and at least one intake and/or exhaust valve which may move axially in the head between a closed position and a position of maximum opening, the electromagnetic actuator being adapted to move this valve, on command, between its closed position and its position of maximum opening, the electromagnetic actuator comprising an oscillating arm having a first end hinged on a fixed support and a second end in abutment on the valve, and a pair of electromagnets disposed on opposite sides of the oscillating arm and adapted to move the oscillating arm, on command, in order axially to displace the valve between the closed position and the position of maximum opening, the electromagnetic actuator being characterised in that the portion of the oscillating arm that faces the electromagnets comprises a pack of sheets of ferromagnetic material.

BRIEF DESCRIPTION OF THE DRAWINGS

The present invention will now be described with reference to the accompanying drawings which show a non-limiting embodiment thereof and in which.

DETAILED DESCRIPTION OF THE INVENTION

Figure 1:
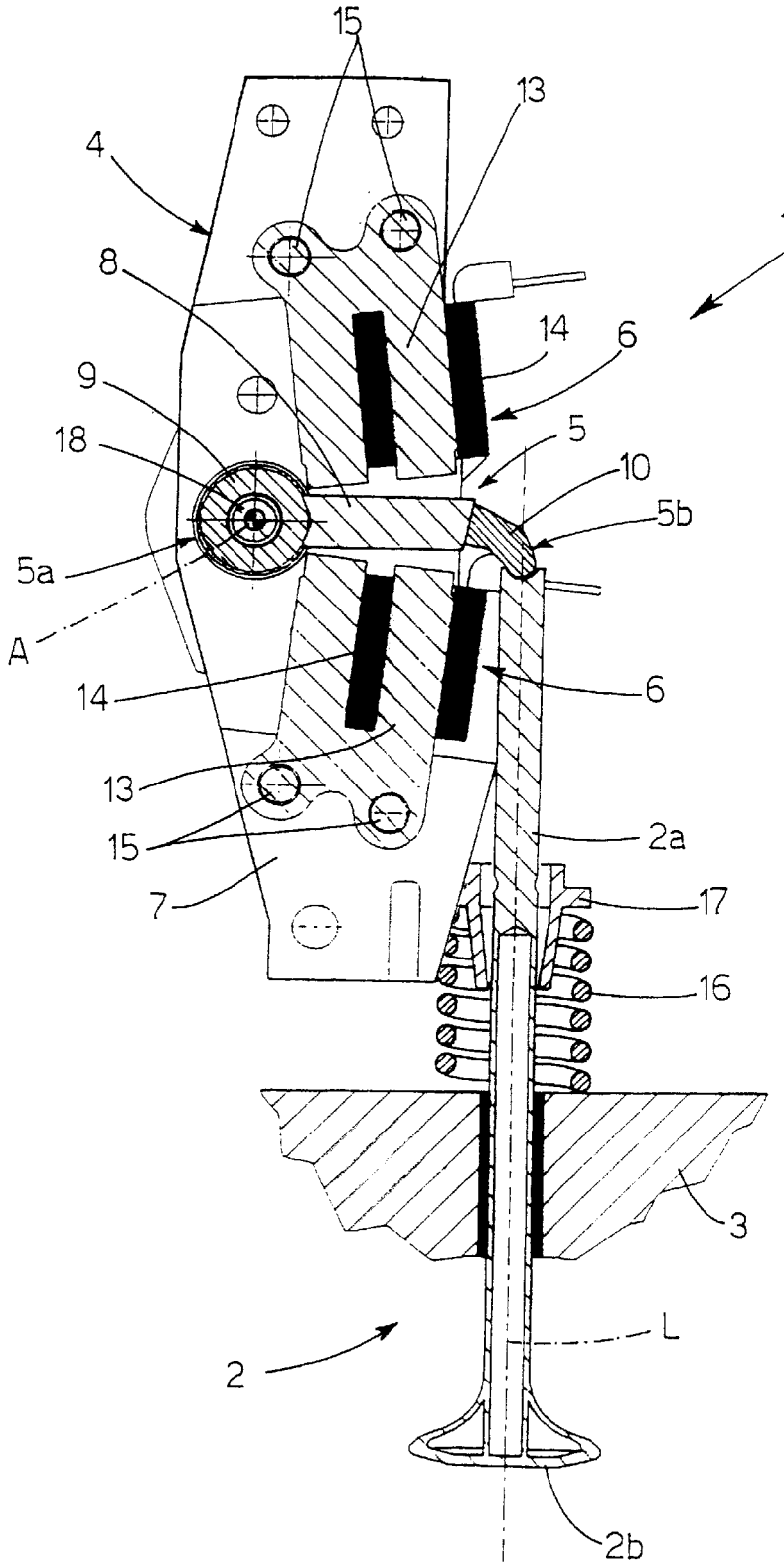
FIG. 1 is a side view, with parts in cross-section and other parts removed for clarity, of an internal combustion engine provided with an electromagnetic actuator for the actuation of the intake and/or exhaust valves according to the present invention.
Figure 2:
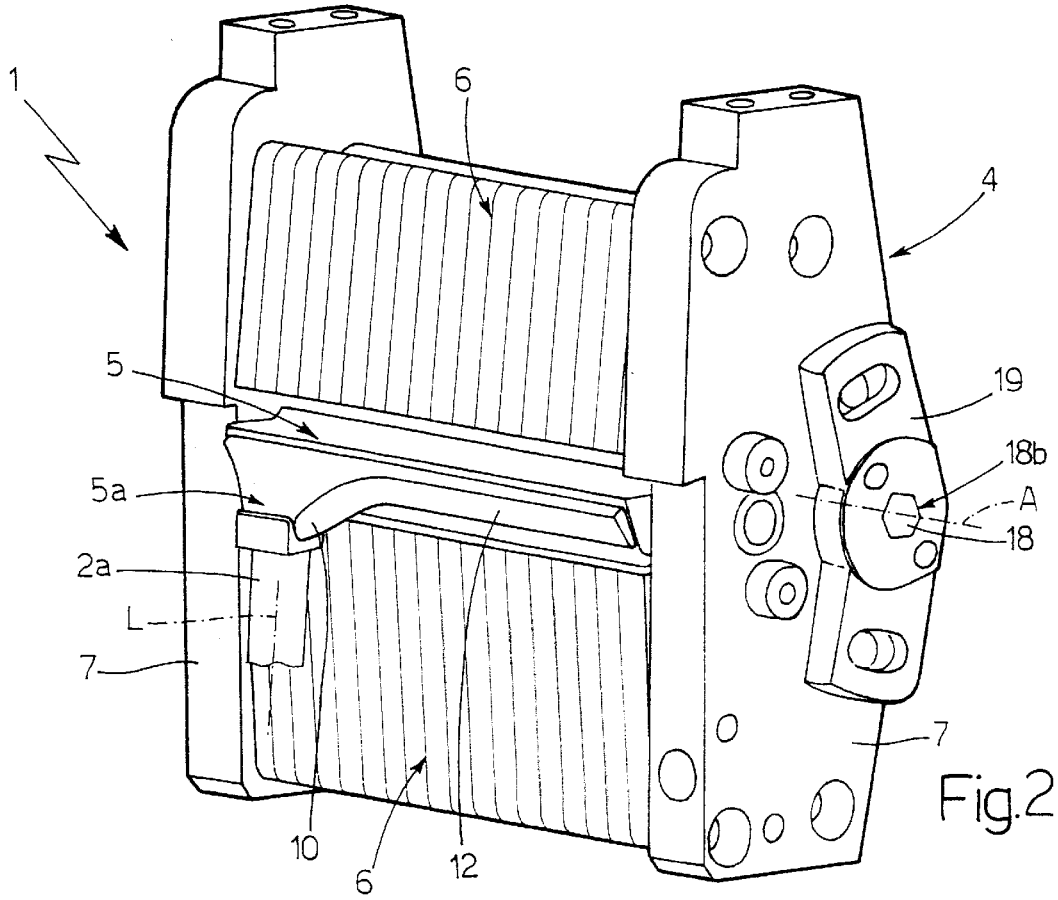
FIG. 2 is a perspective view of the electromagnetic actuator of FIG. 1.

In FIGS. 1 and 2, an electromagnetic actuator adapted to move, on command, at least one intake or exhaust valve 2 of an internal combustion engine is shown overall by 1; the engine normally comprises a base (not shown), one or a plurality of pistons (not shown) mounted to slide axially within respective cylindrical cavities obtained in the body of the base and a head 3 disposed at the apex of the base and closing these cylindrical cavities.

Together with the engine head 3, each piston bounds, within the respective cylindrical cavity, a variable-volume combustion chamber that is connected to the intake manifold and the exhaust manifold of the engine (both of known type and not shown) via at least one intake duct (not shown) and one exhaust duct (not shown) respectively, both obtained in the body of the head 3.

In FIG. 1, the internal combustion engine is lastly provided with a group of these intake and exhaust valves 2 which are adapted respectively to regulate the flow of air into the combustion chamber via the intake duct and the outflow of combusted gases from the combustion chamber 5 via the exhaust duct.

In this case, the internal combustion engine has, at the inlet of each duct, whether it is an intake or exhaust duct, a respective mushroom valve 2 of known type which is mounted on the engine head 3 with its stem 2*a* sliding axially through the body of the head 3 and its head 2*b* moving axially at the location of the inlet of each duct, so that it can move between a closed position in which the head 2*b* of the valve 2 prevents gases from flowing through the intake or exhaust ducts to and from the combustion chamber, and a position of maximum opening in which the head 2*b* of the valve 2 allows gases to flow through the intake or exhaust ducts to and from the combustion chamber with the maximum admissible flow.

In FIGS. 1 and 2, the electromagnetic actuator 1 comprises a support frame 4 secured to the head 3 of the internal combustion engine in a known manner, an oscillating arm 5 of ferromagnetic material having a first end 5*a* hinged on the support frame 4 so that it can oscillate about an axis of rotation A perpendicular to the longitudinal axis L of the valve 2 and a second end 5*b* disposed directly in abutment on the upper end of the stem 2*a* of the valve 2, and a pair of electromagnets 6 disposed one above the other on opposite sides of the central portion of the oscillating arm 5 so as to be able to attract, on command and alternatively, the oscillating arm 5 by causing it to rotate about the axis of rotation A.

In the embodiment shown, the support frame 4 is formed by a pair of parallel plates 7 facing one another, which extend alongside the stem 2*a* of the valve 2 to be axially moved parallel to the longitudinal axis L of the valve 2.

Figure 3:
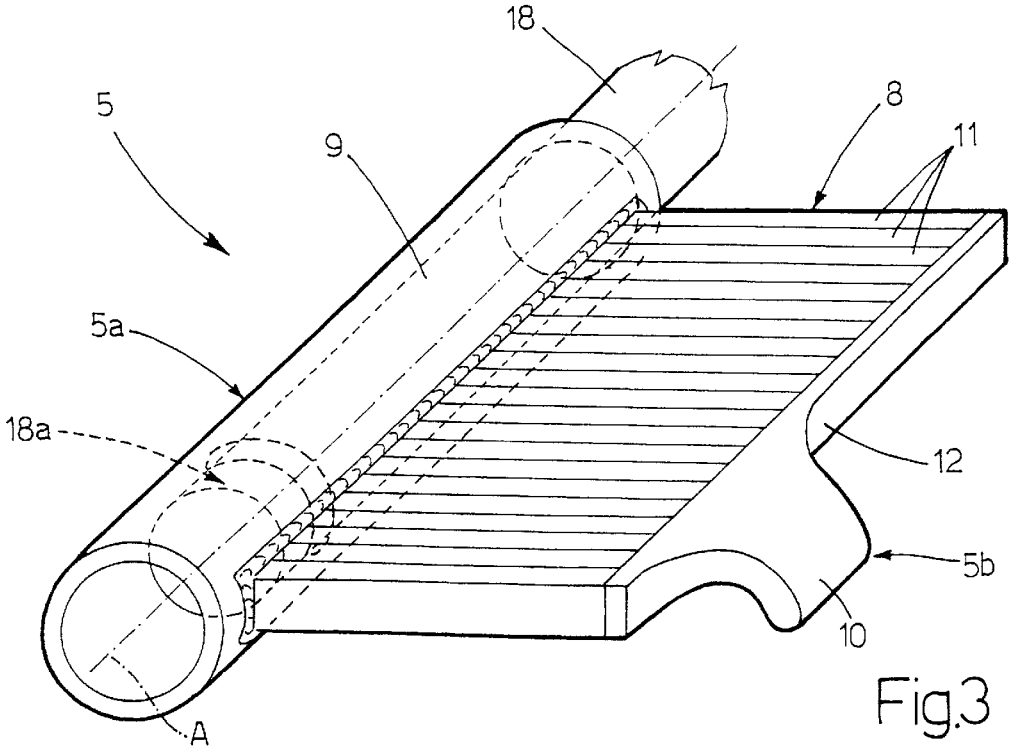
FIG. 3 is a perspective view of a component of the electromagnetic actuator shown in FIGS. 1 and 2.

In FIGS. 1 and 3, the oscillating arm 5 is hinged between the plates 7 which form the support frame 4 and is formed by a central plate 8 of ferromagnetic material positioned in the space between the polar heads of the two electromagnets 6, by a cylindrical tubular member 9 rigid with a lateral edge of the central plate 8 and lastly by a projection 10 extending in a projecting manner from the central plate 8 on the side opposite the cylindrical tubular member 9.

In further detail, with particular reference to FIG. 3, the cylindrical tubular member 9 extends coaxially to the axis of rotation A, is mounted to rotate on the plates 7 that form the support frame 4 via the interposition of roller bearings of known type, and defines the end Sa of the oscillating arm 5. The central plate 8, however, is formed by a pack of sheets 11 of ferromagnetic material stacked on one another and seam welded on the outer lateral surface of the cylindrical tubular member 9 and by a stiffening rib 12 welded to the pack of sheets 11 on the side opposite the cylindrical tubular member 9. The sheets are perpendicular to the axis of rotation A of the oscillating arm 5, while the stiffening rib 12 extends over the entire length of the pack of sheets 11 and is adapted to strengthen this pack of sheets 11, by making it structurally similar to a solid and monolithic plate.

The projection 10 extends, however, in a projecting manner from the stiffening rib 12, is shaped substantially as a curved finger and is disposed directly in abutment on the upper end of the stem 2*a* of the valve 2, defining the end 5*b* of the oscillating arm 5.

With reference to FIG. 1, it will be appreciated that the projection 10 has the shape of a curved finger in order always to maintain the point of contact between the projection 10 and the upper end of the stem 2*a* of the valve 2 below the median plane of the central plate 8 so as to minimise mechanical stresses and to optimise their distribution over the whole of the pack of sheets 11.

The two electromagnets 6 are both disposed between the plates 7 of the frame 4 and each, in the embodiment shown, comprises a U-shaped magnetic core 13 secured to the support frame 4 so that its two polar heads face the central plate 8, and a coil 14 of electrically conducting material keyed on this magnetic core 13.

It will be appreciated that, in the embodiment shown, the magnetic core 13, in order to hysteresis losses, is formed by a pack of sheets of ferromagnetic material held together by locking bolts 15 mounted to pass through the plates 7.

In FIG. 1, the electromagnetic actuator 1 further comprises two elastic members, one of which is adapted to maintain the valve 2 in the closed position and the other of which is adapted to maintain the oscillating arm 5 in abutment on one of the two electromagnets 6, and in particular on that electromagnet 6 against which the oscillating arm 5 would normally move into abutment in order to position the valve 2 in the position of maximum opening.

In this case, the first elastic member of the electromagnetic actuator 1, designated below by reference numeral 16, is formed by a helical spring keyed on the stem 2*a* of the valve 2 so as to have its first end in abutment on the head 3 of the engine, and its second end in abutment on an abutment flange 17 secured to the stem 2*a* of the valve 2. The second elastic member of the electromagnetic actuator 1, designated below by reference numeral 18, is formed, in the embodiment shown, by a torsion bar inserted partially in the cylindrical tubular member 9 so as to have its first end 18*a* angularly rigid with the cylindrical tubular member 9 and its second end 18*b* rigid with one of the plates 7 of the support frame 4 via a locking and adjustment member 19 provided thereon.

It should be borne in mind that the two elastic members, i.e. the helical spring 16 and the torsion bar 18, act in opposition to one another and that their elastic constants are selected such as to position, when neither of the electromagnets 6 is being supplied, i.e. they are in condition of equilibrium, the oscillating arm 5 in a rest position in which it is substantially equidistant from the polar heads of the two electromagnets 6 in order to maintain the valve 2 of the engine in an intermediate position between the closed position and the position of maximum opening.

According to a variant which is not shown, the end 5*b* of the oscillating arm 5, i.e. the projection 10 shaped as a curved finger, is disposed in abutment on the upper end of the stem 2*a* of the valve 2 via the interposition of a mechanical member adapted to minimise the bending stresses to which the stem 2*a* of the valve 2 is subject during operation.

This mechanical member comprises a strut interposed between the upper end of the stem 2*a* of the valve 2 and the end 5*b* of the oscillating arm 5, and an elastic joint adapted to maintain this strut rigid with the stem 2*a* of the valve 2. The strut is formed by a rod dimensioned to withstand and transfer compression loads that extends coaxially to the stem 2*a* of the valve 2 and has a first end in abutment on the upper end of the stem 2*a* of the valve 2, and a second end in abutment on the end 5*b* of the oscillating arm 5. The elastic joint is positioned at the location of the upper end of the stem 2*a* of the valve 2, and is adapted to maintain the rod coaxially to the stem 2*a* of the valve 2, with one of its ends always in abutment on the upper end of the stem 2*a* of the valve 2, thereby enabling small oscillations of this rod.

As the strut is connected to the stem 2*a* of the valve 2 by means of the elastic joint, the mechanical stresses perpendicular to the stem 2*a* of the valve 2 produced by the friction of the end 5*b* of the oscillating arm 5 on the end of the strut, exclusively generate oscillations of the strut that are damped and are not transmitted to the stem 2*a* of the valve 2.

Preferably, but not necessarily, the end of the strut engaged in the elastic joint has a hemispherical shape so as not to impede the oscillations of the strut on the upper end of the stem 2*a* of the valve 2. The rod may further be made in two pieces which are screwed together so that the axial length of the rod can be adjusted in order to regulate mechanical play.

The operation of the electromagnetic actuator 1 can be readily deduced from the above description and illustration: by alternately supplying the two electromagnets 6 it is possible axially to move the valve 2 between the position of maximum opening where the oscillating arm 5 abuts on the electromagnet 6 behind the head 3, and the closed position where the oscillating arm 5 abuts on the upper electromagnet 6.

The advantages resulting from the use of the electromagnetic actuator 1 described and illustrated above are evident: the provision of the central plate 8 in the form of a pack of sheets 11 drastically reduces the parasitic currents circulating in this plate, thereby drastically reducing the quantity of electrical energy that is dissipated and therefore the consumption of electrical energy by the electromagnets 6.

The worsening of the structural rigidity of the oscillating arm 5 due to the provision of the central plate 8 in the form of a pack of sheets 11 is offset, however, by the presence of the stiffening rib 12 which, as it extends over the entire length of the pack of sheets 11, strengthens this pack of sheets 11, making it structurally equivalent to a solid and monolithic plate.

It will be appreciated that modifications and variations may be made to the electromagnetic actuator 1 as described and illustrated without thereby departing from the scope of the present invention.

What is claimed is:

1. An electromagnetic actuator for the actuation of the valves of an internal combustion engine that comprises a head and at least one intake and/or exhaust valve which may move axially in the head between a closed position and a position of maximum opening, the electromagnetic actuator being adapted to move the valve, on command, between its closed position and its position of maximum opening, the electromagnetic actuator comprising an oscillating arm having a first end hinged on a fixed support and a second end in abutment on the valve, and a pair of electromagnets disposed on opposite sides of the oscillating arm and adapted to move the oscillating arm, on command, in order axially to displace the valve between the closed position and the position of maximum opening, the electromagnetic actuator being characterised in that: the portion of the oscillating arm that faces the electromagnets comprises a pack of sheets of ferromagnetic material; the oscillating arm comprises a central plate positioned in the space between the polar heads of the two electromagnets, a pin rigid with a lateral edge of the central plate and a projection extending in a projecting manner from the central plate on the side opposite the pin, the pin being hinged on the fixed support and the portion of the oscillating arm facing the electromagnets being formed by the central plate; and the central plate comprises a stiffening rib secured to the pack of sheets on the side opposite the pin.

2. An electromagnetic actuator as claimed in claim 1, characterised in that the oscillating arm is mounted to rotate on the fixed support about a predetermined axis of rotation and in that the sheets of the pack of sheets extend perpendicular to the axis of rotation.

3. An electromagnetic actuator as claimed in claim 2, characterised in that the pin comprises a cylindrical tubular member extending coaxially to the axis of rotation, the sheets of the pack of sheets being seam welded to the outer lateral surface of the cylindrical tubular member.

4. An electromagnetic actuator as claimed in claim 1, characterised in that the second end of the oscillating arm is defined by a projection extending in a projecting manner from the stiffening rib.

5. An electromagnetic actuator as claimed in claim 4, characterised in that the projection is shaped substantially as a curved finger in order always to maintain the point of contact between the projection and the valve below the median plane of the central plate.

6. An electromagnetic actuator as claimed in claim 1, characterised in that it comprises a first elastic member adapted to maintain the valve in the closed position and a second elastic member adapted to maintain the valve in the position of maximum opening, by exerting an axial thrust contrary to that exerted by the first elastic member on the valve.

7. An electromagnetic actuator as claimed in claim 6, characterised in that the first and the second elastic members are adapted to maintain, in a condition of equilibrium, the valve in an intermediate position between the closed position and the position of maximum opening.

8. An electromagnetic actuator as claimed in claim 1, characterised in that the valve is a mushroom valve mounted with its stem sliding axially through the head of the internal combustion engine, and in that the first elastic member comprises a helical spring keyed on the stem of the valve with a first end in abutment on the head of the engine and a second end in abutment on an abutment flange secured to the stem of the valve.

9. An electromagnetic actuator as claimed in claim 7, characterised in that the second elastic member comprises a torsion bar which has a first end rigid with the first end of the oscillating arm and a second end rigid with the fixed support.

* * * * *

UNITED STATES PATENT AND TRADEMARK OFFICE

CERTIFICATE OF CORRECTION

PATENT NO. : 6,467,441 B2
DATED : October 22, 2002
INVENTOR(S) : Marcello Cristiani et al.

It is certified that error appears in the above-identified patent and that said Letters Patent is hereby corrected as shown below:

Title page,
Item [73], Assignee, delete "Magnetti Marelli S.p.A." and substitute therefor
-- Magneti Marelli S.p.A. --

Signed and Sealed this

Eleventh Day of November, 2003

JAMES E. ROGAN
*Director of the United States Patent and Trademark Office*